US011414958B2

(12) United States Patent
Fripp et al.

(10) Patent No.: US 11,414,958 B2
(45) Date of Patent: Aug. 16, 2022

(54) PROPPANT FLOW BACK RESTRICTION SYSTEMS, METHODS TO REDUCE PROPPANT FLOW BACK, AND METHODS TO DEPLOY A SCREEN OVER A PORT

(71) Applicant: Halliburton Energy Services, Inc., Houston, TX (US)

(72) Inventors: Michael Linley Fripp, Carrollton, TX (US); Richard Decena Ornelaz, Frisco, TX (US); Stephen Michael Greci, Little Elm, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 135 days.

(21) Appl. No.: 16/985,143

(22) Filed: Aug. 4, 2020

(65) Prior Publication Data

US 2022/0042398 A1 Feb. 10, 2022

(51) Int. Cl.

| | |
|---|---|
| ***E21B 34/14*** | (2006.01) |
| ***E21B 34/06*** | (2006.01) |
| ***E21B 43/267*** | (2006.01) |

(52) U.S. Cl.

CPC ..... *E21B 34/142* (2020.05); *E21B 34/063* (2013.01); *E21B 43/267* (2013.01); *E21B 2200/04* (2020.05)

(58) Field of Classification Search

CPC ..... E21B 34/14; E21B 34/06; E21B 43/04; E21B 43/08; E21B 2200/06; E21B 43/10

See application file for complete search history.

(56) References Cited

U.S. PATENT DOCUMENTS

| | | | |
|---|---|---|---|
| 10,508,526 | B2 | 12/2019 | Ring et al. |
| 2016/0298424 | A1 | 10/2016 | Themig |
| 2018/0094508 | A1 | 4/2018 | Smith et al. |
| 2018/0347330 | A1 | 12/2018 | Facca et al. |

FOREIGN PATENT DOCUMENTS

| | | | | |
|---|---|---|---|---|
| CA | 2195712 | A1 * | 7/1997 | ..... E21B 43/12 |
| CA | 2800058 | A1 | 6/2014 | |
| CN | 205805518 | | 12/2016 | |
| WO | 2012100012 | | 7/2012 | |
| WO | 2017173554 | | 10/2017 | |
| WO | 2019151993 | | 8/2019 | |

OTHER PUBLICATIONS

International Search Report and Written Opinion issued for corresponding International PCT Patent Application No. PCT/US2020/045796 dated Apr. 22, 2021.

Schlumberger Limited. Filter Cartridges—Protection for polishing and absolute-rating filters. https://www.slb.com/completions/fluids-and-tools/filtration/filter-cartridges, 2020.

* cited by examiner

*Primary Examiner* — Zakiya W Bates

(74) *Attorney, Agent, or Firm* — McGuireWoods LLP

(57) ABSTRACT

A proppant flow back restriction system includes a tubular extending through a wellbore and having a port disposed along the tubular. The system also includes a screen positioned along the tubular. The system further includes a cover disposed in an interior region of the tubular, where the cover is shiftable from a first position to a second position, and from the second position to a third position. The cover covers the port while the cover is in the first position, and uncovers the port while the cover is in the second position. The cover also engages the screen while shifting from the second position to the third position to shift the screen over the port.

20 Claims, 11 Drawing Sheets

PROPPANT FLOW BACK RESTRICTION SYSTEMS, METHODS TO REDUCE PROPPANT FLOW BACK, AND METHODS TO DEPLOY A SCREEN OVER A PORT

The present disclosure relates generally to proppant flow back restriction systems, methods to reduce proppant flow back, and methods to deploy a screen over a port.

Fluids are sometimes pumped through one or more ports of a tubular into a wellbore during certain well operations, such as hydraulic fracturing operations and well injection operations. For example, during certain hydraulic fracturing operations, fluids containing water and proppant are pumped through one or more ports of the tubular into the wellbore to create cracks in the deep-rock formations through which hydrocarbon resources such as natural gas, petroleum, and brine will flow more freely.

BRIEF DESCRIPTION OF THE DRAWINGS

Illustrative embodiments of the present disclosure are described in detail below with reference to the attached drawing figures, which are incorporated by reference herein, and wherein.

Figure 1:
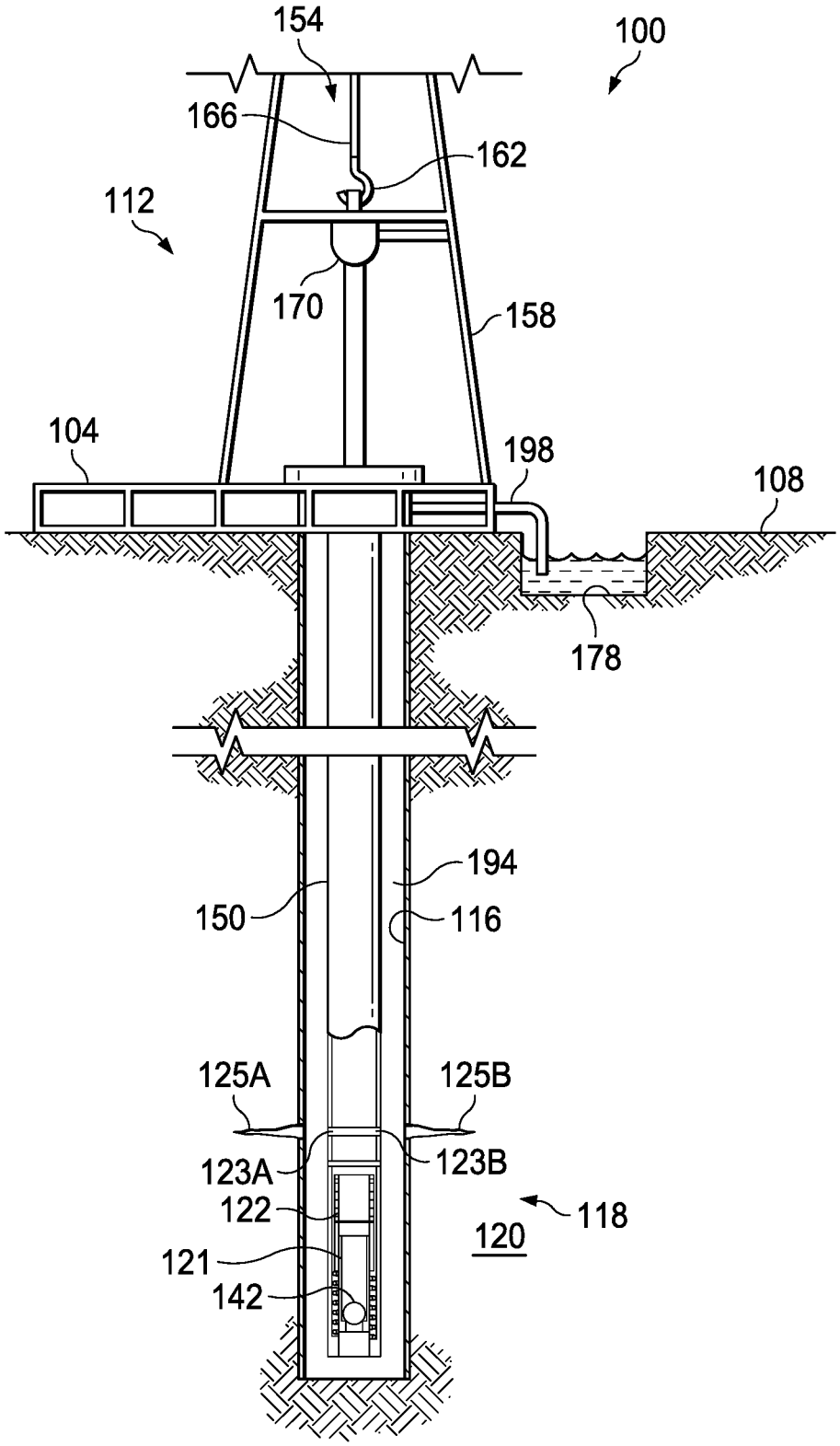
FIG. 1 is a schematic, side view of a completion environment in which a proppant flow back restriction system is deployed in a wellbore.

The illustrated figures are only exemplary and are not intended to assert or imply any limitation with regard to the environment, architecture, design, or process in which different embodiments may be implemented.

DETAILED DESCRIPTION

In the following detailed description of the illustrative embodiments, reference is made to the accompanying drawings that form a part hereof. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

The present disclosure relates to proppant flow back restriction systems, methods to reduce proppant flow back, and methods to deploy a screen over a port. A proppant flow back restriction system includes a tubular that extends through a wellbore of a hydrocarbon well. As referred to herein, a tubular includes casings, oilfield tubulars, production tubing, drill pipes, coiled tubing, and any other type of conveyance having an inner diameter that forms a flowbore for fluids to pass through. The tubular also has at least one port (e.g., a production port, fracture port, as well as other types of openings) that provide fluid passageways from the tubular to the surrounding formation and from the surrounding formation into the tubular during different well operations, such as fracturing operations, injection operations, fracturing operations, or other well operations that utilize the port.

The proppant flow back restriction system also includes a cover that is disposed along an interior of the tubular and is configured to cover the port while the cover is in a first position. As referred to herein, a cover is any device or component configured to prevent or restrict fluid communication through a port or an opening. In some embodiments, a cover is shiftable from a first position, which prevents fluid communication through one or more ports, to a second position to allow fluid communication through the ports. In some embodiments, the cover is a sleeve that is configured to prevent fluid communication through one or more ports while in one position, and is configured to allow fluid communication through the ports while in a second position. A cover includes a hollow interior and a diverter seat that is formed in or is disposed in the hollow interior. As referred to herein, a diverter seat is any device configured to catch or retain a diverter, whereas a diverter is any device configured to engage the diverter seat to shift the cover. Examples of diverter seats include, but are not limited to, ball seats, dart seats, plug seats, and baffles, whereas examples of diverters include, but are not limited to, balls, darts, and plugs that are deployable in the flowbore. In some embodiments, the diverter seat is formed by a tapered profile of the hollow interior, which allows the diverter to flow into one opening of the cover, but prevents the diverter from flowing out of a second opening of the cover. In some embodiments, the diverter seat is electronically, hydraulically, mechanically, or electromagnetically actuated to catch the diverter before the diverter lands on the diverter seat. In some embodiments, the diverter seat has a profile that matches a profile of the diverter.

In some embodiments, where a diverter (such as a ball) is dropped into the flowbore of the tubular, the ball flows downhole until the ball lands on the diverter seat of the cover. Force generated by the ball landing on the diverter seat shifts the cover from a first position to a second position to expose one or more ports previously covered by the cover. In some embodiments, hydraulic pressure applied on the diverter and/or on the cover shifts the cover from the first position to the second position. In some embodiments, the cover is configured to receive a signal (such as electrical signal, acoustic signal, electromagnetic signal, or optical signal, or other type of signal), and is configured to shift from the first position to the second position in response to receiving the signal.

In some embodiments, the cover has a spring that is in a natural state while the cover is in the first position. In some embodiments, the spring is a mechanical spring. In some embodiments, the spring is a fluid spring. In one or more of such embodiments, the diverter landing on the spring compresses the spring, which permits the cover to shift from the first position to the second position. In one or more of such embodiments, hydraulic pressure applied to the diverter and/or the cover compresses the spring, which permits the cover to shift from the first position to the second position. In some embodiments, the spring is compressed in response to a threshold amount of pressure applied to the cover, remains in a compressed state while the threshold amount of pressure is applied to the cover, and returns to a natural state if less than the threshold amount of pressure is applied to the cover. In some embodiments, the spring is compressed in response to a threshold amount of pressure applied to the cover, remains in a compressed state while the threshold amount of pressure is applied to the cover, and shifts the cover to a third position if less than the threshold amount of pressure is applied to the cover. In some embodiments, the cover is configured to shift from the first position to the second position after a threshold period of time. Additional descriptions of mechanisms to shift the cover from the first position to the second position are provided herein and are illustrated in at least FIGS. 2A-2B, 3A-3B, and 4A-4B.

Certain well operations are performed through the port while the cover is in the second position. In some embodiments, a hydraulic fracturing operation is performed through the port to form additional fractures and to enhance existing fractures of the surrounding formation. In some embodiments, fluids containing proppant are injected through the port into the nearby formation. The cover then shifts from the second position to a third position after completion of certain well operations that utilize the port. In some embodiments, where pressure is applied to the diverter and/or to the cover to shift the cover from the first position to the second position, a different amount of pressure is applied to the diverter and/or the cover after the completion of the well operations to shift the cover from the second position to a third position. In some embodiments, where the diverter is formed from a dissolvable, degradable, or corrodible material, the cover is configured to shift from the second position to the third position after a threshold portion of the diverter has dissolved, degraded, corroded, melted, or broken apart. In some embodiments, the cover is configured to shift from the second position to the third position after a threshold period of time. Additional descriptions of mechanisms to shift the cover from the second position to the third position are provided herein and are illustrated in at least FIGS. 2B-2C, 3B-3C, and 4B-4C.

The proppant flow back restriction system has a screen that is engaged by the cover when the cover shifts from the second position to the third position. More particularly, while the cover shifts from the second position to the third position, the cover shifts the screen to a position over the port. As referred to herein, a screen is any device, structure, material, or component that prevents materials greater than a threshold size from flowing through the screen. Examples of screens include, but are not limited to, surface filters such as wire wrap screen assemblies or woven meshes, depth filters like metal wools, and layered fibers. In some embodiments, a screen is a porous structure such as bonded together proppants. In some embodiments, a screen is formed from wires wrapped around a pipe with a gap between the wires, a metal mesh protected by a perforated covering, or a combination of layers of wire wrap, mesh and protective layers. In some embodiments, the screen is shifted over the port prior to commencement of certain well operations, such as production operations, to restrict or prevent solid particles greater than a threshold size from flowing from the surrounding formation through the port and into the tubular.

In some embodiments, the proppant flow back restriction system has multiple ports that provide different flow paths from the tubular to the surrounding formation and from the surrounding formation to the tubular. In one or more of such embodiments, a fluid restrictor, such as an inflow control device (ICD), an autonomous inflow control device (AICD), an adjustable ICD, an inflow control valve (ICV), an autonomous inflow control valve (AICV), or another type of device that is configured to restrict fluid flow is fluidly coupled to at least one port to limit or restrict fluid flow through the second port. Additional descriptions of the proppant flow back restriction system, methods to produce differential flow rate though ports of proppant flow back restriction systems, and methods to reduce proppant flow back are provided in the paragraphs below and are illustrated in FIGS. 1-5.

Turning now to the figures, FIG. 1 is a schematic, side view of a completion environment 100 where a proppant flow back restriction system 118 having a tubular 150, a cover 121 and a screen 122 is deployed in a wellbore 116 of a well 112. As shown in FIG. 1, wellbore 116 extends from surface 108 of well 112 to a subterranean substrate or formation 120. Well 112 and rig 104 are illustrated onshore in FIG. 1. Alternatively, the operations described herein and illustrated in the figures are performed in an off-shore environment. In the embodiment illustrated in FIG. 1, wellbore 116 has been formed by a drilling process in which dirt, rock and other subterranean materials are removed to create wellbore 116. In some embodiments, a portion of wellbore 116 is cased with a casing. In other embodiments, wellbore 116 is maintained in an open-hole configuration without casing. The embodiments described herein are applicable to either cased or open-hole configurations of wellbore 116, or a combination of cased and open-hole configurations in a particular wellbore.

After drilling of wellbore 116 is complete and the associated drill bit and drill string are "tripped" from wellbore 116, tubular 150 is lowered into wellbore 116. In the embodiment of FIG. 1, tubular 150 is lowered by a lift assembly 154 associated with a derrick 158 positioned on or adjacent to rig 104 as shown in FIG. 1. Lift assembly 154 includes a hook 162, a cable 166, a traveling block (not shown), and a hoist (not shown) that cooperatively work together to lift or lower a swivel 170 that is coupled to an upper end of tubular 150. In some embodiments, tubular 150 is raised or lowered as needed to add additional sections to tubular 150 and to run tubular 150 across a desired number of zones of wellbore 116.

In the embodiment of FIG. 1, tubular 150 includes a flowbore 194 that provides a passageway for fluids and solid particles to flow downhole. As referred to herein, downhole refers to a direction along tubular 150 that is away from the surface end of tubular 150, whereas uphole refers to a direction along tubular 150 that is towards the surface end of tubular 150. In some embodiments, flowbore 194 also provides a fluid passageway for a fluid to flow uphole, where the fluid eventually flows into an outlet conduit 198, and from outlet conduit 198 into a container 178. In some embodiments, tubular 150 also provides a fluid flow path for fluids to flow into one or more cross-over ports (not shown) that provide fluid flow around (such as up and/or below) proppant flow back restriction system 118. In one or more of such embodiments, hydraulic pressure is exerted through a cross-over port to shift cover 121 (such as to shift cover 121 downhole) and/or to perform other well operations. In some embodiments, one or more pumps (not shown) are utilized to facilitate fluid flow downhole or uphole, and to generate pressure downhole or uphole.

In the embodiment of FIG. 1, hydraulic pressure applied to cover 121 and/or force generated by landing of a ball 142 on cover 121 has shifted cover 121 downhole to uncover ports 123A and 123B. Additional descriptions of shifting cover 121 to uncover ports are provided herein and are illustrated in at least FIGS. 2A-2C. 3A-3C, and 4A-4C. During certain operations where cover 121 is in the second position as illustrated in FIG. 1, ports 123A and 123B provide fluid flow paths for fluids to flow into and out of tubular 150 and into fractures 125A and 125B of formation 120. In one or more of such embodiments, proppant is pumped through ports 123A and 123B to form new fractures and to expand existing fractures, such as fractures 125A and 125B.

Screen 122 is configured to restrict or prevent solid particles greater than a threshold size from flowing through screen 122. Screen 122 does not cover ports 123A and 123B during certain operations, such as the operations performed while the cover 121 is in the position illustrated in FIG. 1. Moreover, screen 122 is maintained at the position illustrated in FIG. 1 or another position that does not cover ports 123A and 123B during fracturing operations or other operations that may damage screen 122. In some embodiments, screen 122 remains at the position illustrated in FIG. 1 until cover 121 shifts from the position illustrated in FIG. 1 to a third position. In some embodiments, cover 121 shifts from the second position illustrated in FIG. 1 to a third position (not shown) before commencement of certain well operations, such as a production operation. Cover 121 shifts screen 122 from the position illustrated in FIG. 1 to a position (not shown) over ports 123A and 123B to prevent solid particles, such as proppant, from flowing from formation 120 through ports 123A and 123B back into flowbore 194 during the production operation or another well operation that utilizes ports 123A and 123B after cover 121 shifts to the third position.

Although FIG. 1 illustrates ports 123A and 123B, in some embodiments, proppant flow back restriction system 118 has a different number of ports (not shown) that provide fluid communication through tubular 150. In some embodiments, tubular 150 only has one port 123A. In some embodiments, proppant flow back restriction system 118 has one port that is fluidly coupled to a fluid restrictor. Further, although FIG. 1 illustrates one cover 121 and one screen 122, in some embodiments, proppant flow back restriction system 118 includes multiple covers (not shown) and multiple screens (not shown) disposed across multiple zones of wellbore 116. Further, although screen 122 of FIG. 1 is configured to shift over ports 123A and 123B, in some embodiments, screen 122 is configured to shift over a single port (such as 123A), or a different number of ports disposed along tubular 150 to restrict particles greater than a threshold size from flowing into the ports.

Although FIG. 1 illustrates a substantially vertical wellbore 116, the proppant flow back restriction systems described herein are deployable in horizontal wellbores, diagonal wellbores, tortuous shaped wellbores, and other types of wellbores. Further, although FIG. 1 illustrates a proppant flow back restriction system deployed in a completion environment, proppant flow back restriction system 118 is also deployable in other well environments. Similarly, operations described herein may be performed during stimulation operations, production operations, as well as other types of well operations. Additional descriptions of different embodiments of the proppant flow back restriction system are provided herein and are illustrated in FIGS. 2A-2C, 3A-3C, and 4A-4C.

Figure 2A:
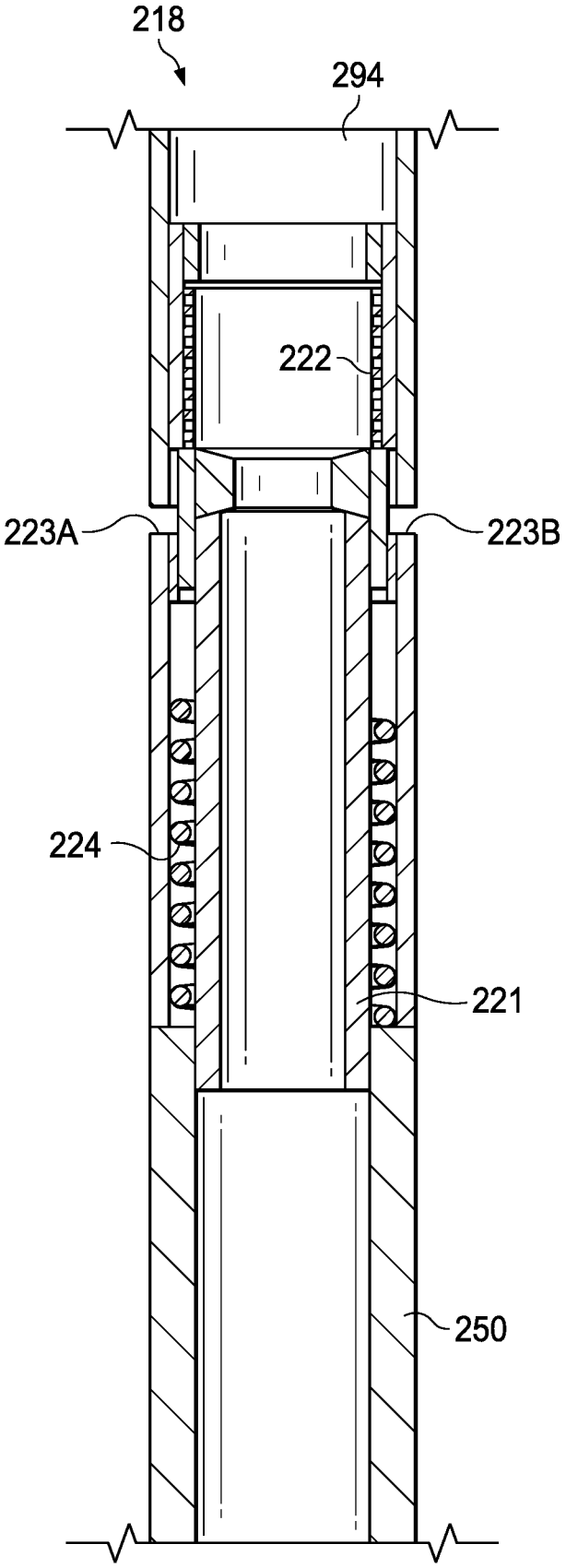
FIG. 2A is a schematic, cross-sectional view of a proppant flow back restriction system that is deployable in the wellbore of FIG. 1, where a cover disposed in the interior of a tubular is in a first position that covers ports of the tubular.

FIG. 2A is a schematic, cross-sectional view of a proppant flow back restriction system 218 that is deployable in wellbore 116 of FIG. 1, where a cover 221 disposed in the interior of tubular 250 is in a first position that covers ports 223A and 223B of tubular 250. More particularly, cover 221 prevents fluid flow from tubular 250 into ports 223A and 223B while cover 221 is in the first position. Cover 221 has a spring 224 that is in a natural state in the embodiment illustrated in FIG. 2A. Pressure or force applied to cover 221 compresses spring 224 into one or more compressed states, which in turn shifts cover 221 to additional positions. Additional configurations of cover 221 are provided in the paragraphs below and are illustrated in at least FIGS. 2B and 2C. Proppant flow back restriction system 218 also includes a screen 222 that shifts from the position illustrated in FIG. 2A to positions illustrated in FIGS. 2B and 2C in response to cover 221 shifting from the position illustrated in FIG. 2A to positions illustrated in FIGS. 2B and 2C. In some embodiments, screen 222 is mechanically coupled to cover 221.

Figure 2B:
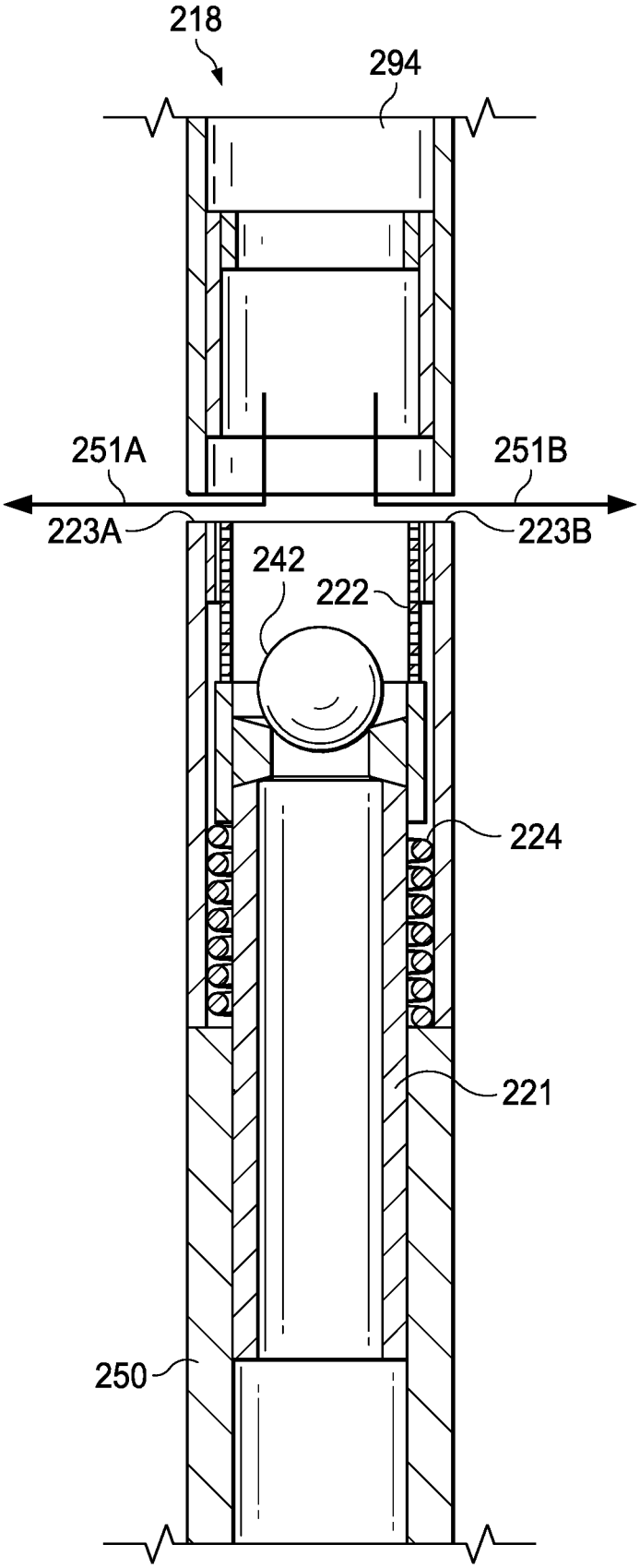
FIG. 2B is a schematic, cross-sectional view of the proppant flow back restriction system of FIG. 2A after the cover shifts from the position illustrated in FIG. 2A to a second position to uncover the ports.

In some embodiments, a threshold amount of pressure is applied through a flowbore 294 of tubular 250 to shift cover 221 from the position illustrated in FIG. 2A to a second position, such as the position illustrated in FIG. 2B. In some embodiments, a diverter, such as a ball 242 of FIG. 2B, is dropped in tubular 250, the diverter flows in flowbore 294 downhole until the diverter lands on cover 221 or on the diverter seat of cover 221. Moreover, force generated by the diverter landing on cover 221 or on the diverter seat and/or hydraulic pressure applied through flowbore 294 compresses spring 224 to a compressed state (first compressed state) and shifts cover 221 from a first position illustrated in FIG. 2A to a second position illustrated in FIG. 2B to uncover ports 223A and 223B, which were previously covered by cover 221 while cover 221 was in the first position as shown in FIG. 2A. In that regard, FIG. 2B is a schematic, cross-sectional view of proppant flow back restriction system 218 of FIG. 2A. Cover 221 shifts from the position illustrated in FIG. 2A to a second position to uncover first set of ports 223A and 223B. The shifting of cover 221 permits fluids flowing in flowbore 294 of tubular 250 to flow through first set of ports 223A and 223B into the surrounding wellbore and formation. In the embodiment of FIG. 2B, solid particles, such as proppant, are pumped through tubular 250, where the solid particles flow out of first set of ports 223A and 223B in directions illustrated by arrows 251A and 251B into the surrounding wellbore and formation, such as into fractures 125A and 125B of FIG. 1, to form additional fractures and to enhance existing fractures.

Screen 222 does not cover first set of ports 223A and 223B during operations performed while the cover 221 is in the position illustrated in FIG. 2B. In some embodiments, screen 222 is maintained at the position illustrated in FIG. 2B to prevent damage to screen 222 during certain operations that utilize first set of ports 223A and 223B. In some embodiments, screen 222 remains at the position illustrated in FIG. 2B until cover 221 shifts from the second position illustrated in FIG. 2B to a third position illustrated in FIG. 2C.

Figure 2C:
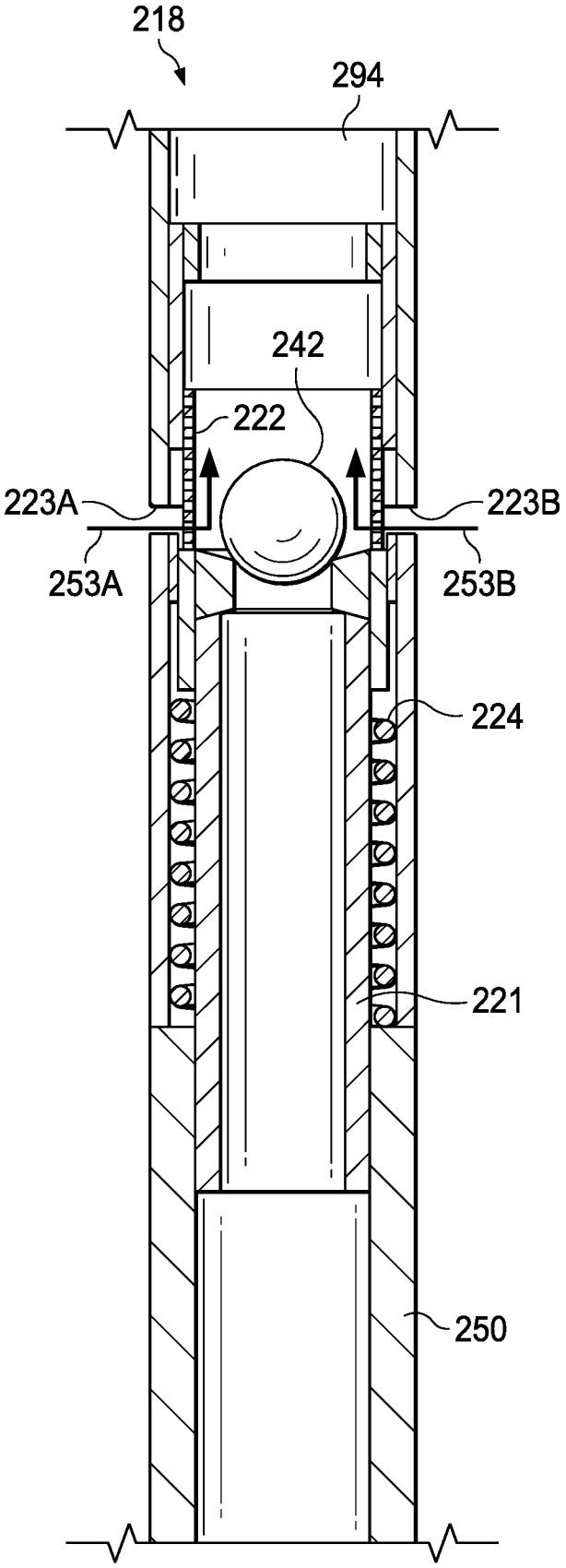
FIG. 2C is a schematic, cross-sectional view of the proppant flow back restriction system of FIG. 2B after the cover shifts from the second position illustrated in FIG. 2B to a third position illustrated in FIG. 2C to shift a screen over the ports.

In that regard, FIG. 2C is a schematic, cross-sectional view of proppant flow back restriction system 218 of FIG. 2B after cover 221 shifts from the second position illustrated in FIG. 2B to a third position illustrated in FIG. 2C to shift a screen 222 over first set of ports 223A and 223B. In some embodiments, a second threshold amount of pressure is applied to cover 221 or ball 242 to shift cover 221 from the second position illustrated in FIG. 2B to the third position illustrated in FIG. 2C. In one or more of such embodiments, the second threshold amount of pressure is less than the threshold amount of pressure applied to shift cover 221 from the first position illustrated in FIG. 2A to the second position illustrated in FIG. 2B. Further, the change in the amount of pressure applied to ball 242 or to cover 221 causes spring 224 to expand from the first compressed state as illustrated in FIG. 2B to a second compressed state as illustrated in FIG. 2C. The expansion of spring 224 from the first compressed state to the second compressed state shifts cover 221 from the second position illustrated in FIG. 2B to the third position illustrated in FIG. 2C. In some embodiments, where ball 242 is formed from a dissolvable, degradable, or corrodible material, spring 224 shifts from the first compressed state to the second compressed state after ball 242 partially or completely dissolves, degrades, or corrodes to shift cover 221 from the second position to the third position.

The shifting of cover 221 to the third position illustrated in FIG. 2C also shifts screen 222 from the position illustrated in FIG. 2B to the position illustrated in FIG. 2C. In some embodiments, screen 222 is initially partially or completely covered by a dissolvable material (not shown) to prevent damage to screen 222. In one or more of such embodiments, the dissolvable material dissolves after the screen 222 is shifted over first set of ports 223A and 223B. First set of ports 223A and 223B remain open while cover 221 is in the third position to permit fluids, such as hydrocarbon resources, to flow from the formation into tubular 250. In the embodiment of FIG. 2C, fluids such as hydrocarbon resources flow from first set of ports 223A and 223B through screen 222 in directions illustrated by arrows 253A and 253B. However, solid particles such as proppant and other particles that are greater than a threshold size are prevented from flowing back into tubular 250 by screen 222.

Although FIGS. 2A-2C illustrate first set of ports 223A and 223B having two ports, in some embodiments, first set of ports only has one port (such as 223A), or a different number of ports. Further, although FIGS. 2A-2C illustrate ball 242 landing on cover 221 to shift cover 221 downhole, in some embodiments, cover 221 is configured to receive a signal (such as electrical signal, acoustic signal, electromagnetic signal, or optical signal, or other type of signal), and is configured to shift from the first position to the second position in response to receiving the signal. In some embodiments, cover 221 is electrically activated to shift from the first position to the second position, and from the second position to the third position. In some embodiments, cover 221 shifts in an uphole direction to uncover first set of ports 223A and 223B, and in a downhole direction to shift screen 222 over first set of ports 223A and 223B. In some embodiments, where the diverter (such as ball 242) is dissolvable, degradable, or melts after a period of time, cover 221 remains in the third position illustrated in FIG. 2C. In some embodiments, cover 221 subsequently shifts from the third position illustrated in FIG. 2C back to the first position illustrated in FIG. 2A or to another position to cover one or more of first set of ports 223A and 223B. In some embodiments, a fluid restrictor, such as an ICD, an AICD, an ICV, an AICV, an adjustable ICD, or another type of device that is configured to restrict fluid flow is fluidly coupled to screen 222 to limit or restrict fluid flow through first set of ports 223A and 223B.

Although proppant flow back restriction system 218 of FIGS. 2A-2C has one cover 221 and one screen 222, in some embodiments, proppant flow back restriction system 218 has multiple covers (not shown) and screens (not shown) that are disposed along tubular 250, and configured to reduce proppant flow back through the ports. In one or more of such embodiments, some of the covers disposed in one zone of the wellbore are configured to shift at times different from covers that are disposed in other zones of the wellbore to individually control the proppant flow back across different zones of the wellbore. In one or more of such embodiments, all of the covers disposed across multiple zones of the wellbore are configured to shift in unison, thereby uniformly reducing proppant flow back across each zone of the wellbore.

Figure 3A:
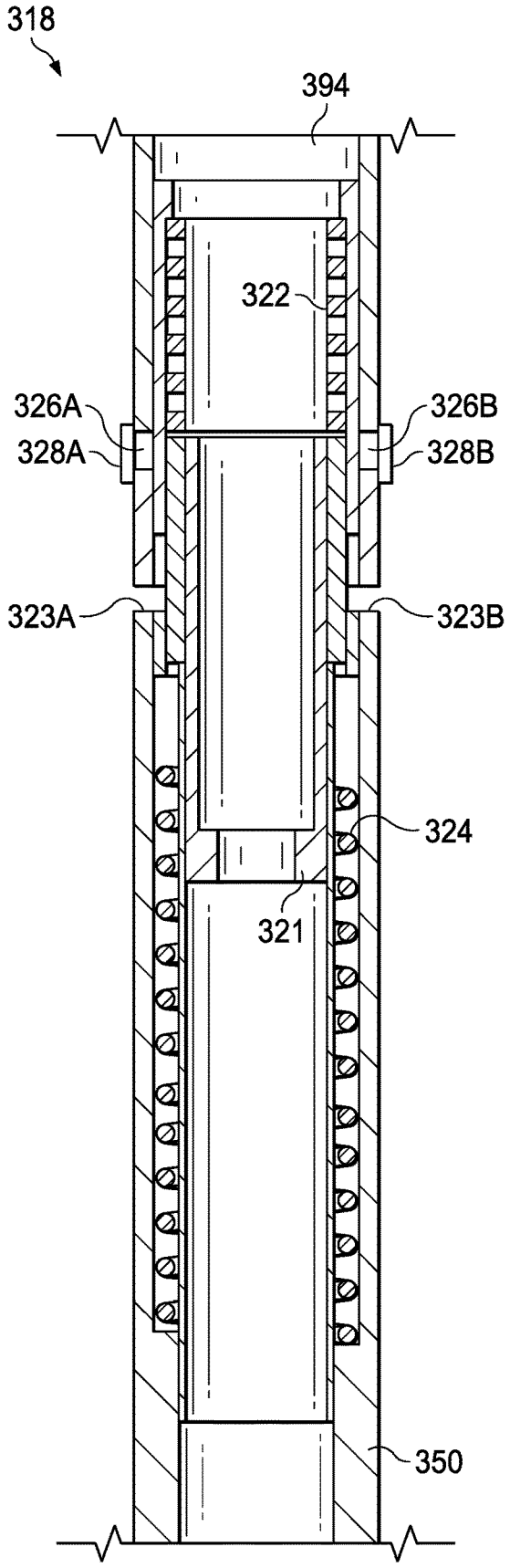
FIG. 3A is a schematic, cross-sectional view of another proppant flow back restriction system that is deployable in the wellbore of FIG. 1, where a cover disposed in the interior of a tubular is in a first position that covers ports of the tubular.

FIG. 3A is a schematic, cross-sectional view of another proppant flow back restriction system 318 that is deployable in the wellbore of FIG. 1, where a cover 321 disposed in the interior of a tubular 350 is in a first position that covers first set of ports 323A and 323B and second set of ports 326A and 326B of the tubular 350. Proppant flow back restriction system 318 also includes fluid restrictors 328A and 328B are fluidly coupled to second set of ports 326A and 326B, respectively, to restrict one or more types of fluids flowing through second set of ports 326A and 326B, respectively. Examples of fluid restrictors 328A and 328B include, but are not limited to, ICDs, AICDs, ICVs, AICVs, adjustable ICDs, or other types of devices that are configured to restrict fluid flow. In the embodiment of FIG. 3A, cover 321 prevents fluid flow from tubular 350 into first set of ports 323A and 323B and second set of ports 326A and 326B while cover 321 is in the first position. Spring 324 and screen 322 of proppant flow back restriction system 318 are similar to spring 224 and screen 222 of proppant flow back restriction system 218 of FIGS. 2A-2C and described herein. Further, operations performed to compress spring 324 and to shift cover 321 are similar to operations performed to compress spring 324 and to shift cover 221 of proppant flow back restriction system 218 and other proppant flow back restriction systems described herein.

Figure 3B:
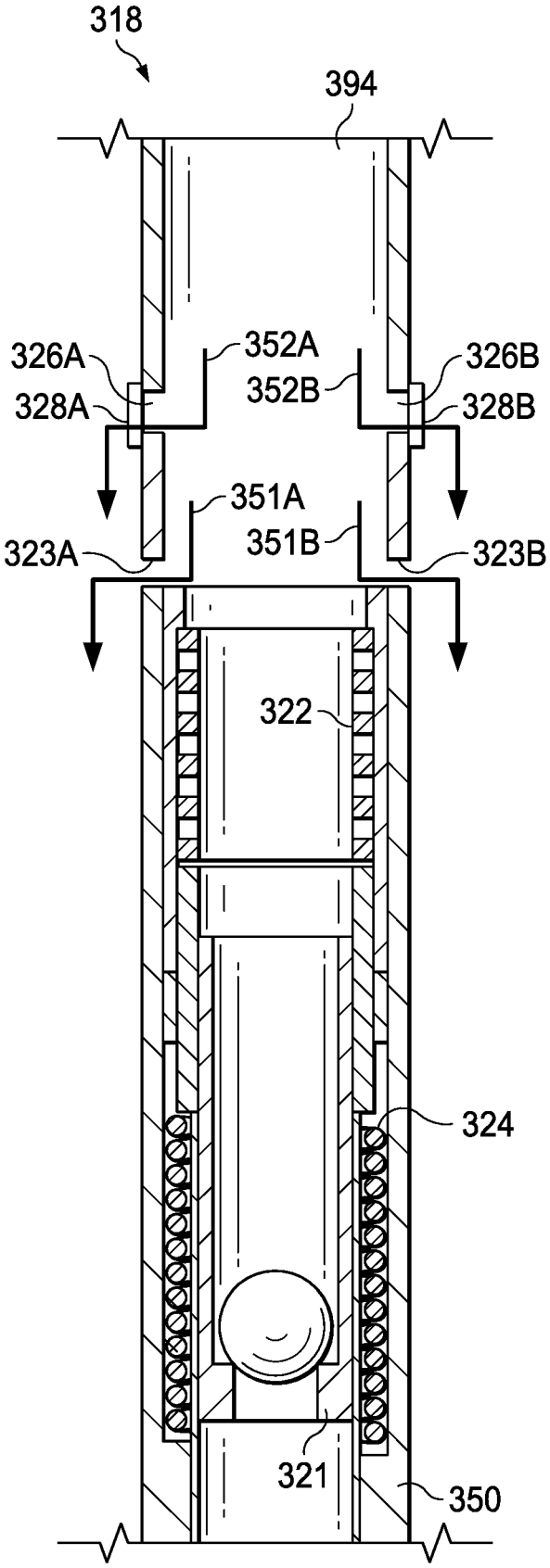
FIG. 3B is a schematic, cross-sectional view of the proppant flow back restriction system of FIG. 3A after the cover shifts from the position illustrated in FIG. 3A to a second position to uncover the ports.

FIG. 3B is a schematic, cross-sectional view of proppant flow back restriction system 318 of FIG. 3A after cover 321 shifts from the position illustrated in FIG. 3A to a second position illustrated in FIG. 3B to uncover first set of ports 323A and 323B and second set of ports 326A and 326B. More particularly, the shifting of cover 321 permits fluids flowing in flowbore 394 of tubular 350 to flow through first set of ports 323A and 323B and second set of ports 326A and 326B into the surrounding wellbore and formation. In the embodiment of FIG. 3B, fluids and solid particles, such as proppant, are pumped through tubular 350, where the solid particles flow out of first set of ports 323A and 323B in directions illustrated by arrows 351A and 351B into the surrounding wellbore and formation, such as into fractures 125A and 125B of FIG. 1, to form additional fractures and to enhance existing fractures. Fluids also flow out of second set of ports 326A and 326B in directions illustrated by arrows 352A and 352B through fluid restrictors 328A and 328B into the surrounding wellbore and formation. In some embodiments, fluid restrictors restrict the flow rate of fluids or the type of fluids that flow out of fluid restrictors 328A and 328B to control the fluid flow during well operations that utilize both first set of ports 323A and 323B and second set of ports 326A and 326B. Screen 322 does not cover any of first set of ports 323A and 323B or second set of ports 326A and 326B during operations performed while the cover 321 is in the position illustrated in FIG. 3B. In some embodiments, screen 322 is maintained at the position illustrated in FIG. 3B to prevent damage to screen 322 during certain operations that utilize first set of ports 323A and 323B and second set of ports 326A and 326B. In some embodiments, screen 322 remains at the position illustrated in FIG. 3B until cover 321 shifts from the second position illustrated in FIG. 3B to a third position illustrated in FIG. 3C.

Figure 3C:
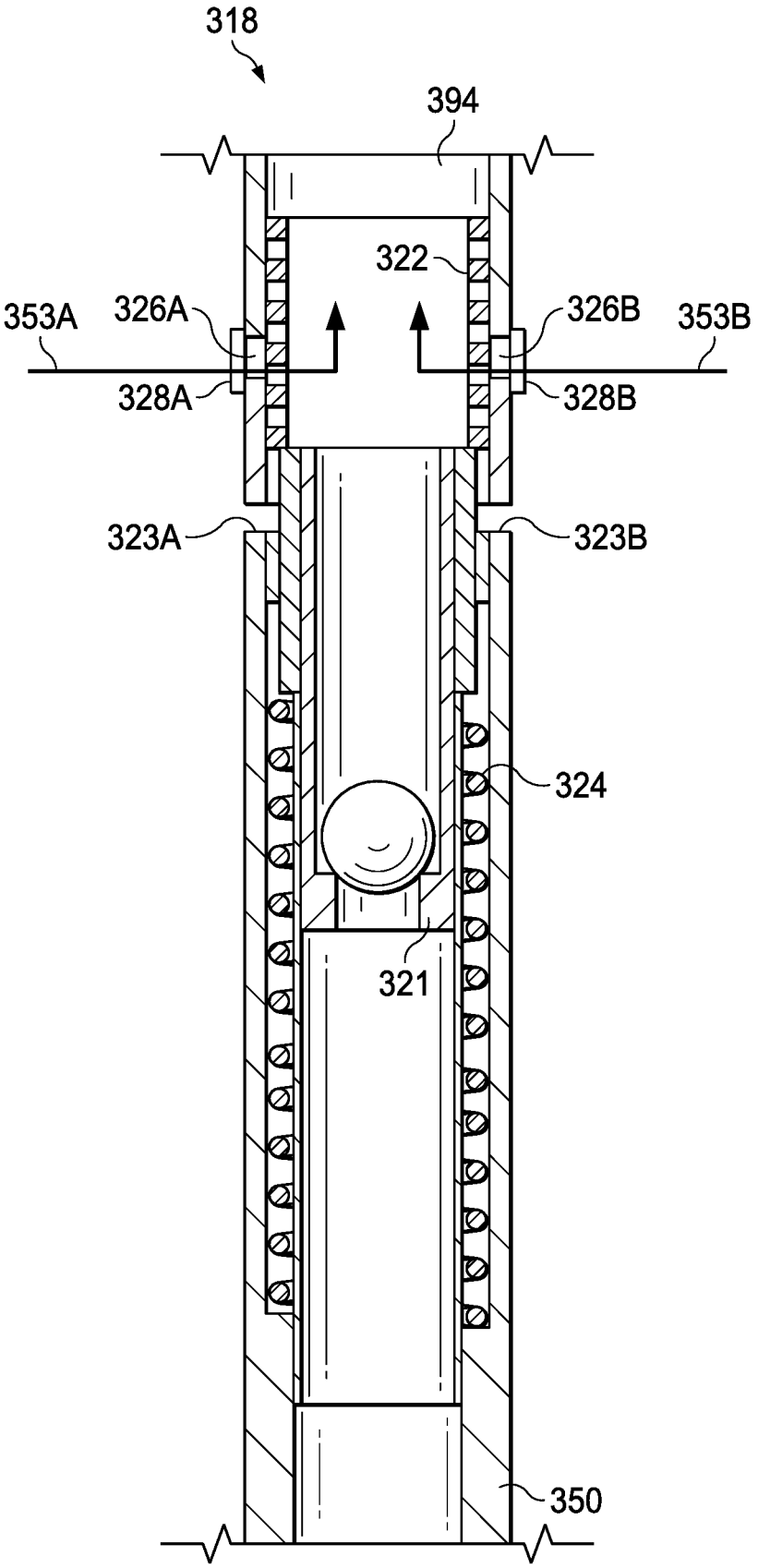
FIG. 3C is a schematic, cross-sectional view of the proppant flow back restriction system of FIG. 3B after the cover shifts from the second position illustrated in FIG. 3B to a third position illustrated in FIG. 3C to shift a screen over some of the ports.

FIG. 3C is a schematic, cross-sectional view of proppant flow back restriction system 318 of FIG. 3B after cover 321 shifts from the second position illustrated in FIG. 3B to a third position illustrated in FIG. 3C to shift screen 322 over second set of ports 326A and 326B. In the embodiment of FIG. 3C, first set of ports 323A and 323B are covered by cover 321 while cover 321 is in the third position. Second set of ports 326A and 326B remain open while cover 321 is in the third position to permits fluids, such as hydrocarbon resources, to flow from the formation into tubular 350, such as in directions illustrated by arrows 353A and 353B. In the embodiment of FIG. 3C, fluids such as hydrocarbon resources first flow through fluid restrictors 328A and 328B, which are fluidly coupled to second set of ports 326A and 326B. In some embodiments, fluid restrictors 328A and 328B permit hydrocarbon resources to flow into second set of ports 326A and 326B, but reduces or restricts fluid flow of water and other types of fluids that flow from the formation into second set of ports 326A and 326B. In some embodiments, fluid restrictors 328A and 328B restricts the flow rate of fluids flowing into second set of ports 326A and 326B to a uniform flow rate or to a desired flow rate. In the embodiment of FIG. 3C, screen 322 has shifted over second set of ports 326A and 326B to restrict or prevent solid particles such as proppant and other particles that are greater than a threshold size from flowing back into tubular 350.

Although FIGS. 3A-3C illustrate first set of ports 323A and 323B and second set of ports 326A and 326B, each having two ports, in some embodiments, each of first set of ports and second set of ports only has one port (such as 323A and 326A), or a different number of ports. In some embodiments, cover 321 shifts in an uphole direction to uncover first set of ports 323A and 323B, second set of ports 326A and 326B, and additional sets of ports (not shown). Moreover, cover 321 subsequently shifts in a downhole direction to shift screen 322 over second set of ports 326A and 326B. In some embodiments, a fluid restrictor, such as an ICD, an AICD, an ICV, an AICV, an adjustable ICD, or another type of device that is configured to restrict fluid flow, is fluidly coupled to screen 322 to limit or restrict fluid flow through first set of ports 323A and 323B.

Although proppant flow back restriction system 318 of FIGS. 3A-3C has one cover 321 and one screen 322, in some embodiments, proppant flow back restriction system 318 has multiple covers (not shown) and screens (not shown) that are disposed along tubular 350, and configured to reduce proppant flow back through the ports. In one or more of such embodiments, some of the covers disposed in one zone of the wellbore are configured to shift at times different from covers that are disposed in other zones of the wellbore to individually control the proppant flow back across different zones of the wellbore. In one or more of such embodiments, all of the covers disposed across multiple zones of the wellbore are configured to shift in unison, thereby uniformly reducing proppant flow back across each zone of the wellbore.

Figure 4A:
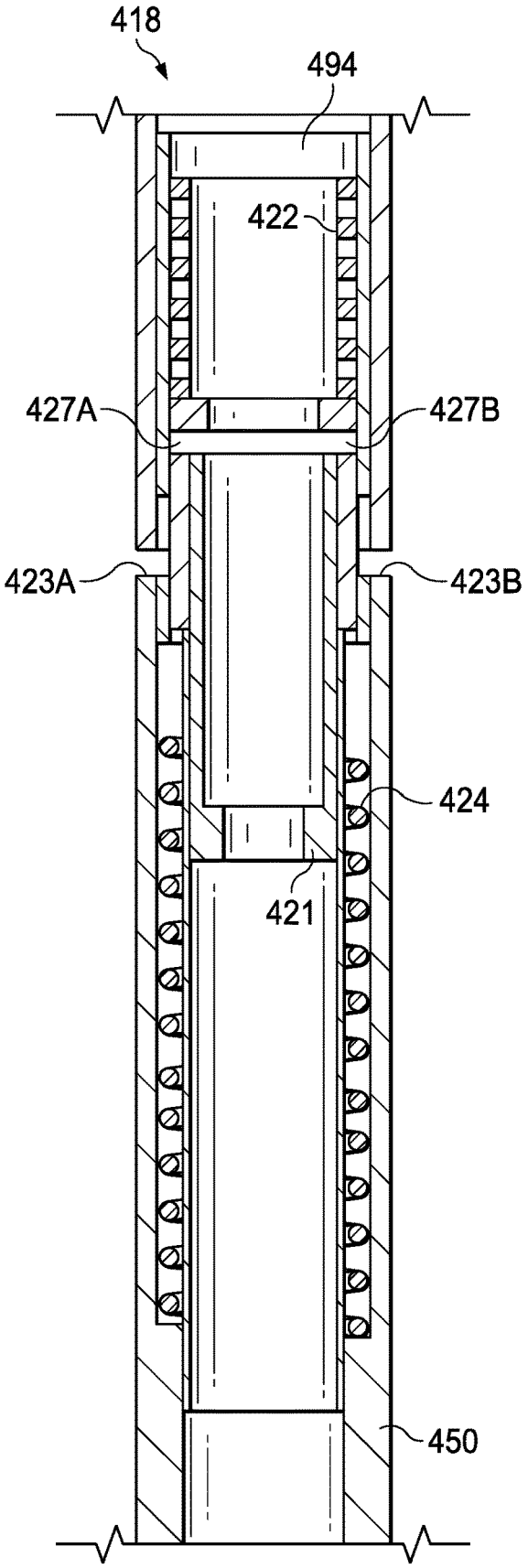
FIG. 4A is a schematic, cross-sectional view of another proppant flow back restriction system that is deployable in the wellbore of FIG. 1, where a cover disposed in the interior of a tubular is in a first position that covers ports of the tubular.

FIG. 4A is a schematic, cross-sectional view of another proppant flow back restriction system 418 that is deployable in the wellbore of FIG. 1, where a cover 421 disposed in the interior of a tubular 450 is in a first position that covers first set of ports 423A and 423B of tubular 450. In the embodiment of FIG. 4A, cover 421 prevents fluid flow from tubular 450 into first set of ports 423A and 423B while cover 421 is in the first position. Spring 424 and screen 422 of proppant flow back restriction system 418 are similar to spring 224 and screen 222 of proppant flow back restriction system 218 of FIGS. 2A-2C and described herein. Cover 421 of proppant flow back restriction system 418 is also similar to cover 221 of proppant flow back restriction system 218 of FIG. 2. However, cover 421 has additional openings 427A and 427B that align with or fluid couples to first set of ports 423A and 423B, when cover 421 shifts to certain positions, such as the second position of FIG. 4B.

Figure 4B:
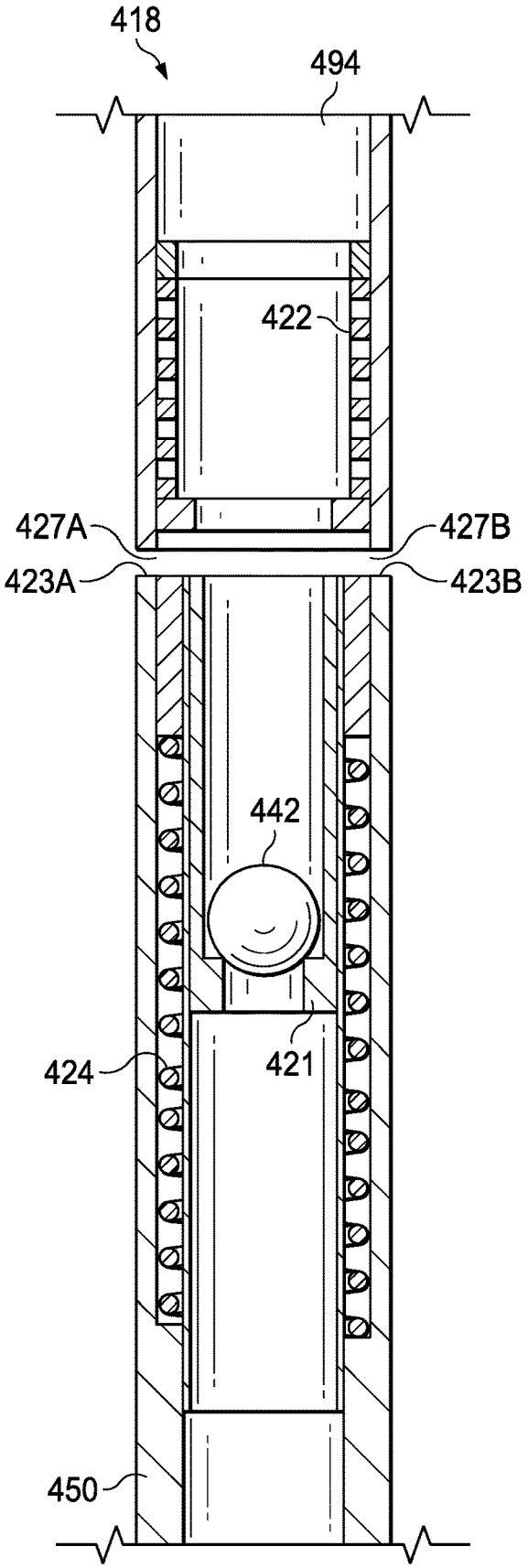
FIG. 4B is a schematic, cross-sectional view of the proppant flow back restriction system of FIG. 4A after the cover shifts from the position illustrated in FIG. 4A to a second position to fluidly couple openings of the cover with the ports.

In some embodiments, a threshold amount of pressure is applied through a flowbore 494 of tubular 450 to shift cover 421 from the position illustrated in FIG. 4A to a second position, such as the position illustrated in FIG. 4B. In some embodiments, a diverter such as a ball 442 of FIG. 4B is dropped in tubular 450, where ball 442 flows in flowbore 494 downhole until ball 442 lands on cover 421 or on the diverter seat of cover 421. Moreover, force generated by ball 442 landing on cover 421 or on the diverter seat and/or hydraulic pressure applied through flowbore 494 compresses spring 424 to a compressed state (first compressed state) and shifts cover 421 from the first position illustrated in FIG. 4A to a second position illustrated in FIG. 4B to uncover ports 423A and 423B, which were previously covered by cover 421 while cover was in the first position as shown in FIG. 4A.

In that regard, FIG. 4B is a schematic, cross-sectional view of proppant flow back restriction system 418 of FIG. 4A after cover 421 shifts from the position illustrated in FIG. 4A to a second position to fluidly couple openings 427A and 427B of cover 421 to first set of ports 423A and 423B. The shifting of cover 421 permits fluids flowing in flowbore 494 of tubular 450 to flow through first set of ports 423A and 423B into the surrounding wellbore and formation. In the embodiment of FIG. 4B, solid particles, such as proppant, are pumped through tubular 450, where the solid particles flow out of first set of ports 423A and 423B into the surrounding wellbore and formation, such as into fractures 125A and 125B of FIG. 1, to form additional fractures and to enhance existing fractures. Screen 422 does not cover first set of ports 423A and 423B during operations performed while the cover 421 is in the position illustrated in FIG. 4B.

In some embodiments, screen 422 is maintained at the position illustrated in FIG. 4B to prevent damage to screen 422 during certain operations that utilize first set of ports 423A and 423B. In some embodiments, screen 422 remains at the position illustrated in FIG. 4B until cover 421 shifts from the second position illustrated in FIG. 4B to a third position illustrated in FIG. 4C.

Figure 4C:
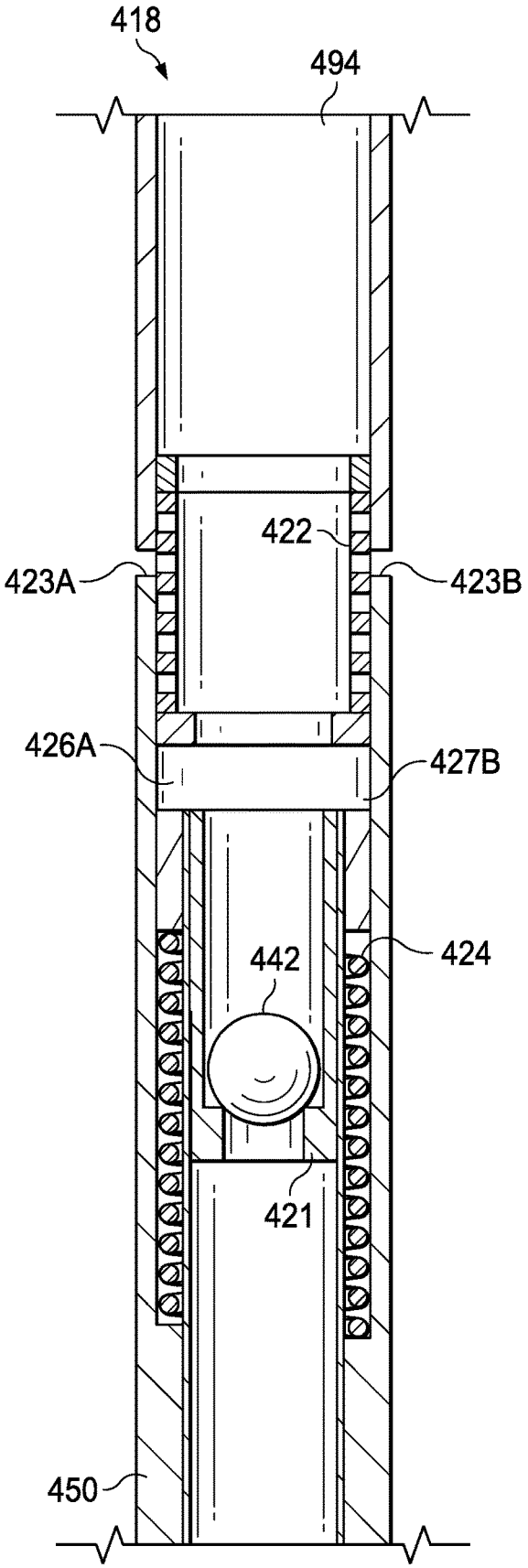
FIG. 4C is a schematic, cross-sectional view of the proppant flow back restriction system of FIG. 4B after the cover shifts from the second position illustrated in FIG. 4B to a third position illustrated in FIG. 4C to shift a screen over the ports.

FIG. 4C is a schematic, cross-sectional view of proppant flow back restriction system 418 of FIG. 4B after cover 421 shifts from the second position illustrated in FIG. 4B to a third position illustrated in FIG. 4C to shift screen 422 over first set of ports 423A and 423B. In the embodiment of FIGS. 4B-4C, an additional amount of pressure (second threshold amount of pressure) is applied to cover 421 or ball 442 to further compress spring 424 to a second compressed state and shift cover 421 from the second position illustrated in FIG. 4B to the third position illustrated in FIG. 4C. In the embodiment of FIG. 4C, openings 427A and 427B are no longer aligned with or fluidly coupled to ports 423A and 423B after cover 421 shifts to the third position. Further, shifting of cover 421 to the third position illustrated in FIG. 4C also shifts screen 422 from the position illustrated in FIG. 4B to the position illustrated in FIG. 4C. First set of ports 423A and 423B remain open while cover 421 is in the third position to permit fluids, such as hydrocarbon resources, to flow from the formation through first set of ports 423A and 423B into tubular 450. However, solid particles such as proppant and other particles that are greater than a threshold size are prevented from flowing back into tubular 450 by screen 422.

Although FIGS. 4A-4C illustrate first set of ports 423A and 423B and openings 427A and 427B, in some embodiments, cover 421 has a different number of openings that are aligned to or fluidly coupled to a different number of openings when cover 421 shifts to a certain position. In some embodiments, a fluid restrictor, such as an ICD, an AICD, an ICV, an AICV, an adjustable ICD, or another type of device that is configured to restrict fluid flow, is fluidly coupled to screen 422 to limit or restrict fluid flow through first set of ports 423A and 423B. Although proppant flow back restriction system 418 of FIGS. 4A-4C has one cover 421 and one screen 422, in some embodiments, proppant flow back restriction system 418 has multiple covers (not shown) and screens (not shown) that are disposed along tubular 450, and configured to reduce proppant flow back through the ports. In one or more of such embodiments, some of the covers disposed in one zone of the wellbore are configured to shift at times different from covers that are disposed in other zones of the wellbore to individually control the proppant flow back across different zones of the wellbore. In one or more of such embodiments, all of the covers disposed across multiple zones of the wellbore are configured to shift in unison, thereby uniformly reducing proppant flow back across each zone of the wellbore.

Figure 5:
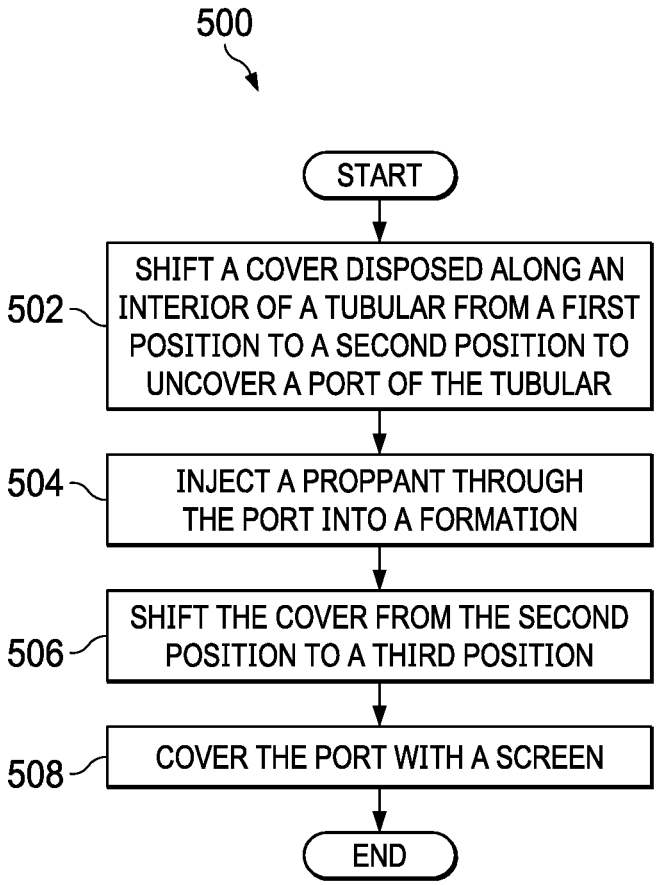
FIG. 5 is a flow chart of a process to reduce proppant flow back.

FIG. 5 is a flow chart of a process 500 to produce differential flow rate through a port during different wellbore operations. Although the operations in the process 500 are shown in a particular sequence, certain operations may be performed in different sequences or at the same time where feasible.

At block 502, a cover that is disposed along an interior of the tubular is shifted from a first position to a second position to uncover a port of the tubular. FIGS. 2A-2B, for example, illustrate shifting cover 221 from a first position illustrated in FIG. 2A to a second position illustrated in FIG. 2B to uncover port 223A. In the embodiment of FIGS. 2A-2B, hydraulic pressure applied to ball 242 and/or to cover 221 compresses spring from a natural state illustrated in FIG. 2A to a first compressed state illustrated in FIG. 2B to shift cover 221 from the position illustrated in FIG. 2A to the position illustrated in FIG. 2B and to uncover port 223A. In some embodiments, the force of ball 242 landing on cover 221 compresses spring 224 of FIG. 2B and shifts cover 221 from the first position illustrated in FIG. 2A to the second position illustrated in FIG. 2B. In some embodiments, cover 221 is electronically, acoustically, optically, or electromagnetically activated. In some embodiments, cover 221 shifts to the second position before commencement of certain well operations, such as injection operations, fracturing operations, or other well operations that utilize ports initially covered by the cover 221.

At block 504, proppant is injected through the port into a formation surrounding the tubular. In the embodiment of FIG. 2B, fluids and solid particles such as proppant flow out of port 223A in the direction indicated by arrow 251A into the surrounding formation, such as into fractures 125A of formation 120 of FIG. 1. Similarly, in the embodiments of FIGS. 3B and 4B, respectively, proppant flows out of ports 323A and 423A, respectively, into the surrounding formation. At block 506, and after proppant is injected into the formation, the cover is shifted from the second position to a third position. In that regard, FIGS. 2B-2C illustrate shifting cover 221 from the position illustrated in FIG. 2B to the position illustrated in FIG. 2C. In some embodiments, a first amount of pressure is applied to shift the cover from the first position to the second position, and a second amount of pressure is applied to shift the cover from the second position to the third position. In one or more of such embodiments, a first amount of pressure is applied to shift covers 221, 321, and 421 of FIGS. 2A, 3A, and 4A, respectively, from the first positions illustrated in FIGS. 2A, 3A, and 4A to the second positions illustrated in FIGS. 2B, 3B, and 4B. In one or more of such embodiments, a second amount of pressure that is less than the first amount of pressure is applied to covers 221 and 321 to shift covers 221 and 321 from the second positions illustrated in FIGS. 2B and 3B to the third positions illustrated in FIGS. 2C and 3C. In or more of such embodiments, a second amount of pressure that is greater than the first amount of pressure is applied to cover 421 to shift cover 421 from the second position illustrated in FIG. 4B to the third position illustrated in FIG. 4C.

At block 508, the port is covered with a screen. FIGS. 2B-2C illustrate cover 221 engaging screen 222 while shifting from the second position to the third position to shift screen 222 over port 223A. FIGS. 3B-3C and 4B-4C also illustrate similar operations performed to shift cover 321 and 421 from second positions to third positions, and to shift screens 322 and 422 over ports 323A and 423A.

The above-disclosed embodiments have been presented for purposes of illustration and to enable one of ordinary skill in the art to practice the disclosure, but the disclosure is not intended to be exhaustive or limited to the forms disclosed. Many insubstantial modifications and variations will be apparent to those of ordinary skill in the art without departing from the scope and spirit of the disclosure. The scope of the claims is intended to broadly cover the disclosed embodiments and any such modification. Further, the following clauses represent additional embodiments of the disclosure and should be considered within the scope of the disclosure:

Clause 1, a proppant flow back restriction system, comprising a tubular extending through a wellbore and having a port disposed along the tubular; a screen positioned along the tubular, the screen being shiftable from a first screen position to a second screen position over the port; and a cover disposed in an interior region of the tubular, wherein the cover is shiftable from a first position to a second position, and from the second position to a third position, wherein the cover covers the port while the cover is in the first position, and uncovers the port while the cover is in the second position, and wherein the cover engages the screen while shifting from the second position to the third position to shift the screen from the first screen position to the second screen position.

Clause 2, the proppant flow back restriction system of clause 1, wherein after the cover shifts from the first position to the second position, the cover shifts from the second position to the third position if less than a threshold amount of pressure is applied to the cover.

Clause 3, the proppant flow back restriction system of clause 2, wherein the cover comprises a spring that is compressed when the cover shifts from the first position to the second position, wherein the spring is configured to remain compressed if the threshold amount of pressure is applied to the cover.

Clause 4, the proppant flow back restriction system of any of clauses 1-2, wherein the cover is configured to shift from the second position to the third position after a threshold period of time.

Clause 5, the proppant flow back restriction system of any of clauses 1-4, wherein the screen is configured to filter particles greater than a threshold size from flowing through the port.

Clause 6, the proppant flow back restriction system of any of clauses 1-5, wherein the port provides a first fluid flow path from the tubular to the wellbore while the cover is in the second position, and wherein the port provides a second fluid flow path from the wellbore to the tubular while the cover is in the third position.

Clause 7, the proppant flow back restriction system of any of clauses 1-6, further comprising an inflow control device that is fluidly coupled to a second port disposed along the tubular, wherein the cover covers the second port while the cover is in the first position, and uncovers the second port while the cover is in the second position or the third position.

Clause 8, the proppant flow back restriction system of clause 7, wherein the cover covers the port while the cover is in the third position, and wherein the second port provides a fluid flow path from the wellbore through the inflow control device and into the tubular while the cover is in the third position.

Clause 9, the proppant flow back restriction system of clauses 7 or 8, wherein the inflow control device restricts fluid flow in a direction from the tubular through the second port and into the wellbore.

Clause 10, the proppant flow back restriction system of any of clauses 1-9, further comprising an autonomous inflow control device that is fluidly coupled to a second port disposed along the tubular, wherein the cover covers the second port while the cover is in the first position.

Clause 11, the proppant flow back restriction system of any of clauses 1-10, wherein the cover is configured to shift from the first position to the second position in response to a diverter landing on the cover.

Clause 12, the proppant flow back restriction system of any one of clauses 1-11, wherein the cover comprises a diverter seat configured to receive at least one of a ball, a dart, and a plug.

Clause 13, the proppant flow back restriction system of clause 12, wherein the cover comprises a profile and is configured to receiving a diverter having a matching profile.

Clause 14, the proppant flow back restriction system of any of clauses 1-13, further comprising a dissolvable material that covers the screen while the screen is in the first screen position, and wherein the dissolvable material dissolves after the screen is in the second screen position.

Clause 15, a method to reduce proppant flow back, the method comprising: shifting a cover disposed along an interior of a tubular from a first position to a second position to uncover a port of the tubular; injecting a proppant through the port into a formation surrounding the tubular; after injecting the proppant, shifting the cover from the second position to a third position; and covering the port with a screen, wherein the cover engages the screen while shifting from the second position to the third position to shift the screen over the port.

Clause 16, the method of clause 15, further comprising performing a fracturing operation through the port to fracture the formation while the cover is in the second position, wherein the cover is shifted from the second position to the third position after performance of the fracturing operation.

Clause 17, the method of clauses 15 or 16, further comprising flowing a fluid from the formation through the screen and into the tubular while restricting the proppant from flowing through the screen.

Clause 18, the method of any of clauses 15-17, further comprising: uncovering a second port by shifting the cover from the first position to the second position; covering the port by shifting the cover from the second position to the third position; and covering the second port with the screen, wherein the cover engages the screen while shifting from the second position to the third position to shift the screen over the second port.

Clause 19, a method to deploy a screen over a port, the method comprising: shifting a cover disposed along an interior of a tubular from a first position to a second position to uncover a port of the tubular; shifting the cover from the second position to a third position, wherein the cover engages a screen while shifting from the second position to the third position to shift the screen over the port; and covering the port with a screen.

As used herein, the singular forms "a," "an," and "the" are intended to include the plural forms as well, unless the context clearly indicates otherwise. It will be further understood that the terms "comprise" and/or "comprising," when used in this specification and/or in the claims, specify the presence of stated features, steps, operations, elements, and/or components, but do not preclude the presence or addition of one or more other features, steps, operations, elements, components, and/or groups thereof. In addition, the steps and components described in the above embodiments and figures are merely illustrative and do not imply that any particular step or component is a requirement of a claimed embodiment.

Arrows indicating directions of fluid flow are illustrated for illustration purposes only. It is understood that fluids may flow in additional directions not shown in the Figures.

What is claimed is:

1. A proppant flow back restriction system, comprising:

a tubular extending through a wellbore and having a port disposed along the tubular;

a screen positioned along the tubular, the screen being shiftable from a first screen position to a second screen position over the port; and a cover disposed in an interior region of the tubular, wherein the cover is configured to receive at least one of an electrical signal, acoustic signal, an electromagnetic signal, and an optical signal, and shiftable from a first position to a second position, and from the second position to a third position after receiving the at least one of the electrical signal, the acoustic signal, the electromagnetic signal, and the optical signal, wherein the cover covers the port while the cover is in the first position, and uncovers the port while the cover is in the second position, and wherein the cover engages the screen while shifting from the second position to the third position to shift the screen from the first screen position to the second screen position.

2. The proppant flow back restriction system of claim 1, wherein after the cover shifts from the first position to the second position, the cover shifts from the second position to the third position if less than a threshold amount of pressure is applied to the cover.

3. The proppant flow back restriction system of claim 2, wherein the cover comprises a spring that is compressed when the cover shifts from the first position to the second position, wherein the spring is configured to remain compressed if the threshold amount of pressure is applied to the cover.

4. The proppant flow back restriction system of claim 1, wherein the cover is configured to shift from the second position to the third position after a threshold period of time.

5. The proppant flow back restriction system of claim 1, wherein the screen is configured to filter particles greater than a threshold size from flowing through the port.

6. The proppant flow back restriction system of claim 1, wherein the port provides a first fluid flow path from the tubular to the wellbore while the cover is in the second position, and wherein the port provides a second fluid flow path from the wellbore to the tubular while the cover is in the third position.

7. The proppant flow back restriction system of claim 1, further comprising an inflow control device that is fluidly coupled to a second port disposed along the tubular, wherein the cover covers the second port while the cover is in the first position, and uncovers the second port while the cover is in the second position or the third position.

8. The proppant flow back restriction system of claim 7, wherein the cover covers the port while the cover is in the third position, and wherein the second port provides a fluid flow path from the wellbore through the inflow control device and into the tubular while the cover is in the third position.

9. The proppant flow back restriction system of claim 7, wherein the inflow control device restricts fluid flow in a direction from the tubular through the second port and into the wellbore.

10. The proppant flow back restriction system of claim 1, further comprising an autonomous inflow control device that is fluidly coupled to a second port disposed along the tubular, wherein the cover covers the second port while the cover is in the first position.

11. The proppant flow back restriction system of claim 1, wherein the cover is configured to shift from the first position to the second position in response to a diverter landing on the cover.

12. The proppant flow back restriction system of claim 1, wherein the cover comprises a diverter seat configured to receive at least one of a ball, a dart, and a plug.

13. The proppant flow back restriction system of claim 12, wherein the cover comprises a profile and is configured to receiving a diverter having a matching profile.

14. The proppant flow back restriction system of claim 1, further comprising a dissolvable material that covers the screen while the screen is in the first screen position, and wherein the dissolvable material dissolves after the screen is in the second screen position.

15. A method to reduce proppant flow back, the method comprising:

receiving a wireless activation signal, the wireless activation signal being at least one of an electrical signal, acoustic signal, an electromagnetic signal, and an optical signal;

in response to receiving a wireless activation signal, shifting a cover disposed along an interior of a tubular from a first position to a second position to uncover a port of the tubular;

injecting a proppant through the port into a formation surrounding the tubular;

after injecting the proppant, shifting the cover from the second position to a third position; and covering the port with a screen, wherein the cover engages the screen while shifting from the second position to the third position to shift the screen over the port.

16. The method of claim 15, further comprising performing a fracturing operation through the port to fracture the formation while the cover is in the second position, wherein the cover is shifted from the second position to the third position after performance of the fracturing operation.

17. The method of claim 15, further comprising flowing a fluid from the formation through the screen and into the tubular while restricting the proppant from flowing through the screen.

18. The method of claim 15, further comprising:

uncovering a second port by shifting the cover from the first position to the second position;

covering the port by shifting the cover from the second position to the third position; and covering the second port with the screen, wherein the cover engages the screen while shifting from the second position to the third position to shift the screen over the second port.

19. A method to deploy a screen over a port, the method comprising:

receiving a wireless activation signal, the wireless activation signal being at least one of an electrical signal, acoustic signal, an electromagnetic signal, and an optical signal;

in response to receiving a wireless activation signal, shifting a cover disposed along an interior of a tubular from a first position to a second position to uncover a port of the tubular;

shifting the cover from the second position to a third position, wherein the cover engages a screen while shifting from the second position to the third position to shift the screen over the port; and covering the port with a screen.

20. The method of claim 19, further comprising:

applying a first amount of pressure to the cover to shift the cover from the first position to the second position; and applying a second amount of pressure to the cover to shift the cover from the second position to the third position, wherein the second amount of pressure is less than the first amount of pressure.

* * * * *